US010444709B2

(12) United States Patent
Carreel et al.

(10) Patent No.: US 10,444,709 B2
(45) Date of Patent: Oct. 15, 2019

(54) STRAP WATCH WITH EXTENDED FEATURES

(71) Applicant: Withings, Issy les Moulineaux (FR)

(72) Inventors: Eric Carreel, Meudon (FR); Cédric Hutchings, Issy les Moulineaux (FR)

(73) Assignee: WITHINGS, Issy les Moulineaux (FR)

( * ) Notice: Subject to any disclaimer, the term of this patent is extended or adjusted under 35 U.S.C. 154(b) by 0 days.

(21) Appl. No.: 14/487,237

(22) Filed: Sep. 16, 2014

(65) Prior Publication Data

US 2015/0085622 A1 Mar. 26, 2015

(30) Foreign Application Priority Data

Sep. 23, 2013 (FR) ..... 13 59107

(51) Int. Cl.

| | |
|---|---|
| ***G04B 47/06*** | (2006.01) |
| ***G04B 37/00*** | (2006.01) |
| ***G04B 19/04*** | (2006.01) |
| ***G04G 21/02*** | (2010.01) |

(52) U.S. Cl.

CPC ..... *G04B 47/063* (2013.01); *G04B 19/04* (2013.01); *G04B 37/0008* (2013.01); *G04G 21/02* (2013.01)

(58) Field of Classification Search

CPC .... G04B 47/06; G04B 47/061; G04B 47/063; G04B 19/06; G04B 19/08; G04B 19/087

USPC ..... 368/11, 80

See application file for complete search history.

(56) References Cited

U.S. PATENT DOCUMENTS 2,716,327 A * 8/1955 Franklin ..... G04B 47/066 116/266
3,377,860 A * 4/1968 Masters ..... G04B 47/066 368/10
3,910,117 A * 10/1975 Wicklund ..... G04B 47/066 73/291
D318,807 S * 8/1991 Lambert ..... D10/30

(Continued)

FOREIGN PATENT DOCUMENTS

CH 237989 A * 6/1945 ..... G01K 1/16
CH 668349 A * 12/1988 ..... G04B 47/06

(Continued)

OTHER PUBLICATIONS

Kasapi, CH 697528 English Translation, Nov. 28, 2008, full document.*

(Continued)

*Primary Examiner* — Daniel P Wicklund

(74) *Attorney, Agent, or Firm* — Miller, Matthias & Hull LLP

(57) ABSTRACT

A strap watch with a first hand normally indicating the hours, a second hand normally indicating the minutes, where appropriate an additional hand, at least one accelerometer, and an electronic control unit which is configured so that it normally causes the time to be indicated by the hands, calculates at least one individual activity amount representative of a physical activity of the user based on information collected by the accelerometer, and displays the activity amount by means of at least one of the hands, whereby the user can very simply view one or more amount(s) relating to his or her physical activity on a compact and conventional analog watch interface.

14 Claims, 3 Drawing Sheets

(56) References Cited

U.S. PATENT DOCUMENTS

| | | | | |
|---|---|---|---|---|
| 5,251,190 | A * | 10/1993 | Miyasaka | G04G 21/02 368/10 |
| 6,269,054 | B1 * | 7/2001 | Truini | 368/29 |
| 6,314,058 | B1 * | 11/2001 | Lee | 368/10 |
| 6,513,532 | B2 | 2/2003 | Mault et al. | |
| 6,547,728 | B1 * | 4/2003 | Cornuejols | 600/300 |
| 7,778,115 | B2 * | 8/2010 | Ruchonnet | G01L 7/163 368/101 |
| 8,436,810 | B2 * | 5/2013 | Langereis et al. | 345/156 |
| 2004/0233788 | A1 * | 11/2004 | Plancon et al. | 368/11 |
| 2005/0122845 | A1 * | 6/2005 | Lizzi | G04C 3/146 368/80 |
| 2008/0068932 | A1 * | 3/2008 | Mosley | A61B 5/14532 368/281 |
| 2008/0151700 | A1 * | 6/2008 | Inoue et al. | 368/80 |
| 2009/0164219 | A1 * | 6/2009 | Yeung | G04C 3/002 704/258 |
| 2009/0185451 | A1 * | 7/2009 | Rochat | B63C 11/02 368/11 |
| 2009/0185452 | A1 * | 7/2009 | Veuthey et al. | 368/11 |
| 2013/0033970 | A1 * | 2/2013 | Miyake | 368/80 |
| 2013/0106603 | A1 * | 5/2013 | Weast | G06F 1/163 340/539.11 |
| 2013/0286793 | A1 * | 10/2013 | Umamoto | 368/67 |
| 2014/0104991 | A1 * | 4/2014 | Rochat et al. | 368/11 |
| 2014/0200691 | A1 * | 7/2014 | Lee | G06F 19/00 700/91 |
| 2016/0157740 | A1 * | 6/2016 | Kampman | A61B 5/02438 600/483 |

FOREIGN PATENT DOCUMENTS

| | | | | |
|---|---|---|---|---|
| CH | 697528 | B1 * | 11/2008 | G04B 47/06 |
| EP | 1571506 | A1 | 9/2005 | |
| EP | 1936450 | A1 | 6/2008 | |
| EP | 2624079 | A1 | 8/2013 | |
| GB | 506127 | A * | 5/1939 | G04B 47/06 |
| WO | WO 2007107900 | A2 | 9/2007 | |
| WO | WO 2012043096 | A1 * | 4/2012 | |
| WO | WO 2012095712 | A1 | 7/2012 | |

OTHER PUBLICATIONS

Perruchi, English Translation of CH 668349, originally publshed Dec. 30, 1988, full document.*

* cited by examiner

STRAP WATCH WITH EXTENDED FEATURES

CROSS-REFERENCE TO RELATED APPLICATION

This application claims priority under the Paris Convention to French Patent Application No. 13 59107 filed on Sep. 23, 2013

FIELD OF THE DISCLOSURE

The present invention relates to strap watches intended to be worn by a user, for example on the wrist.

BACKGROUND OF THE DISCLOSURE

More particularly, the invention relates to a strap watch able to estimate one or more amounts of individual activity representative of the physical activity of the user, and to display some or all of this information.

It is known, for example from document U.S. Pat. No. 6,513,532, to display this information in digital form, particularly in the form of bar graphs. In practice, however, the readability of such bar graphs proves inadequate. This drawback becomes even more significant when trying to incorporate such bar graphs into a watch with a conventional analog display.

There is therefore a need to provide a solution for displaying one or more quantities of individual activity representative of the physical activity of the user and/or supplemental external information, on a conventional analog watch having classical hands (or 'pointers') as indicators.

SUMMARY OF THE DISCLOSURE

For this purpose, the invention proposes a strap watch intended to be worn by a user, typically for example on the wrist, comprising:

a first hand normally indicating the hours, a second hand normally indicating the minutes, at least one accelerometer, an electronic control unit, wherein the electronic control unit is configured so that it normally causes the time to be indicated by the hands, is configured to calculate at least a first individual activity amount representative of a physical activity of the user based on information collected by the accelerometer, and is configured to display, on an analog gauge type of display, said first activity amount by means of at least one of said first and second hands and/or by means of a separate additional hand, whereby the user can very simply view one or more amount(s) relating to his or her physical activity on a conventional analog watch interface.

With these arrangements, one can easily use a standard analog display, based on conventional analog gauges, to provide the user with information concerning his or her physical activity. It should be noted that the use of an analog display is beneficial from a power consumption point of view because no power is consumed when the hand is not being moved.

Note that the additional hand, distinct from the first and second hands, may be the hand that normally indicates the seconds, or in other words the seconds hand, or may be a specific hand as will be seen below.

In embodiments of the device according to the invention, one or more of the following arrangements may be used:

the additional hand may be formed by a third hand that normally indicates the seconds, said third hand being mounted on the same axis as the first and second hands; the hand referred to as the "seconds hand" is advantageously used to display information that is quite different from counting the seconds as they pass; preferably the display is large in size and the readability of such information by the user is improved; the same resource is thus shared by two quite different functions;

the additional hand may be formed by a specific hand mounted on an axis separate from that of the first and second hands so as to form an additional gauge display; this allows the user to have continual access to one or more amount(s) relating to his or her physical activity simply by looking at the watch;

the watch may further comprise at least one digital display area, preferably pixel-based, for displaying information related to the physical activity of the individual; this allows displaying one or more amount(s) relating to his or her physical activity, to supplement the analog display, according to a mode which may be selected by the user and which may be continuous;

the watch may further comprise at least one user button, preferably in the form of a selector dial, so that the user can easily select one of the available display modes;

the watch may further comprise at least one wireless communication means adapted to allow sending and/or receiving data to and from a remote entity, whereby the watch can display by means of the additional hand the information received from said remote entity;

the watch may further comprise a mode selection indicator hand, so that the user can directly obtain visual information concerning the selected mode.

The invention also relates to a method implemented in an analog strap watch as described above, the method comprising the steps of:

a—capturing information, by means of an accelerometer, relating to at least one physical activity of a user, b—calculating at least a first amount of individual activity representative of a physical activity of the user, c—displaying, using an analog gauge-based display, said first amount of activity by means of at least one of the hands.

In embodiments of the method according to the invention, one or more of the following arrangements may possibly be used:

the additional hand is formed by the seconds hand, which is the hand normally indicating the seconds; this allows having a large display and thus good readability;

the following steps may additionally be provided:

causing the first amount of individual activity to be displayed by tapping on the watch or by actuating the user button or by a predetermined gesture, so that easy and intuitive access is provided to the different display modes available;

returning to a conventional display of the time by tapping on the watch or by actuating the user button or by a predetermined gesture, or after a predetermined dwell time;

selecting a display mode from among a plurality of available display modes by tapping on the watch or by actuating the user button or by a predetermined gesture; this provides a simple and intuitive way to select the most appropriate mode for the user;

additional information may also be displayed in a digital display area, thereby complementing the analog display.

Regardless of the presence or absence of an accelerometer in the watch, the invention also relates to a strap watch intended to be worn by a user, comprising:

a first hand normally indicating the hours, a second hand normally indicating the minutes, an electronic control unit, a wireless communication means, wherein the electronic control unit is configured so that it normally causes the time to be indicated by the hands, is configured to receive at least one amount from a remote entity, and is configured to display, on an analog gauge type of display, said amount by means of at least one of said hands or by means of a separate additional hand, whereby the user can very simply view one or more amount(s) received from remote entity(ies) on a conventional analog watch style of interface.

Note that the amount received may be of any type, a physical or non-physical value, an analog value or a digital value or a selection value, as will be seen below. Other features and advantages of the invention will be apparent from the following description of one of its embodiments given by way of non-limiting example, with reference to the accompanying drawings.

DETAIL DESCRIPTION OF THE DISCLOSURE

In the various figures, the same references are used to denote identical or similar elements.

Figure 1:
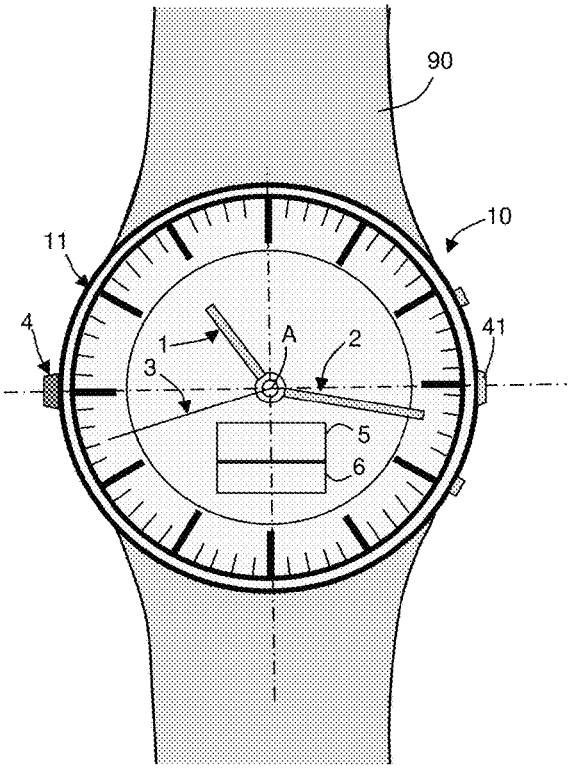
FIG. 1 is a general view of the strap watch according to the invention.

FIG. 1 represents an example of a strap watch 10 according to the invention, which comprises a main watch body 11 and a watchband 90.

Conventionally, in the case of an analog watch (a watch with hands, as opposed to a digital display), a first hand 1 indicates the hours, and a second hand 2 indicates the minutes. Each hand 1,2 is a physical rigid piece of material, for example a thin stick of plastic, pivotally mounted around axis A.

Often, although not systematically, there may also be a third hand 3 for indicating the seconds. This third hand is also referred to as the "seconds hand" and is thinner than the other two hands.

The hands 1,2 are driven by a drive mechanism comprising one or more micromotors. In the example illustrated, each of the three hands is driven by a separate micromotor; However, it is possible for the hour hand 1 and the minute hand 2 to be connected together by a mechanical gear system in which case one micromotor is sufficient to drive the first and second hands.

In the particular example illustrated in FIGS. 1 to 4, the first hand 1 is driven by a first micromotor 11, the second hand 2 is driven by a second micromotor 12, and the third hand 3 is driven by a third micromotor 13. The three micromotors in question are controlled by an electronic control unit 8 housed inside the main body of the watch. In a known manner, quartz-based timekeeping allows the electronic control unit 8 to count the passage of time and display the hours/minutes/seconds with the hands.

In addition, at least one user button 4 is provided to allow for example setting the time and/or accessing different display modes and/or additional functions of the watch. Other additional buttons 41 may be provided for a stopwatch function, lighting function, or any other known function in the field of watches.

In the example illustrated, a first digital display area 5 is provided, for example composed of LCD segments or a pixel array. Its utility will be seen below.

In the example shown, a second digital display area 6 is also provided, similar to the first one in composition and technology.

The strap watch further comprises at least one accelerometer 7; in the illustrated example, it is a six-axis sensor capable of measuring linear accelerations in the three orthogonal directions X, Y and Z as well as rotational movements about the three orthogonal directions X, Y and Z. For the detection of rotational movements, it makes use of miniature gyroscopes 71,72,73, preferably embedded in a single electronics package (also including the linear accelerometers, for example in a "MEMS" circuit) installed directly on the board 15 supporting the control unit. It should be noted that it is possible to use a simpler accelerometer than a six-axis one.

Similarly, additional sensors could be provided of types such as the gyroscope, magnetometer, altimeter, or other, to supplement the information provided by the accelerometer.

The acceleration signals provided by the accelerometer are analyzed by the electronic control unit 8, which after algorithmic processing, can deduce the number of steps taken by the wearer of the strap watch, and where appropriate the number of stairs climbed, uphill slopes climbed, and any other information resulting from user movement and representative of his or her physical activity.

In other words, the electronic control unit 8 calculates or estimates at least one amount of individual activity representative of the physical activity of the user wearing the strap watch 10.

Advantageously, several amounts of individual activity are calculated, such as the number of steps taken in a day, the energy expenditure in calories (or MET: "Metabolic Equivalent Task"), the total distance covered during the day, the number of stairs climbed, etc.

The strap watch further comprises an electrical storage battery 88, for example a button battery. This battery is intended to supply power for all electrical and electronic equipment housed in the strap watch. This battery may be a rechargeable battery. A luminous flux charging solution is possible, for example using an arrangement of photodiodes arranged on the face of the watch. A kinetic recharging solution based on recovering energy from movements undergone by the watch is also possible.

The strap watch further comprises a wireless communication interface 18 that is preferably BLUETOOTH Low Energy (a.k.a. BLUETOOTH "LE", "BLE", and BLUETOOTH Smart), although any other equivalent solution is also possible, so that the strap watch can exchange data via a connection 20 with a remote entity such as a smartphone 80 also equipped with a compatible wireless interface.

In this manner, it is possible to set the watch time automatically via a web service and to send an appropriate command from the smartphone (or other device) to the watch. This interface further allows receiving one or more amounts for analog display, from one or more remote entities, as will be seen below.

In addition, the watch may be provided with one or more lighting devices 62 adapted to illuminate the entire watch in general or to illuminate certain specific display elements.

In the invention, a conventional gauge-based analog display is provided for displaying one or more individual activity amounts such as those mentioned above. According to the solution shown in FIG. 2, the third hand 3 is used, or in other words the seconds hand, to display an amount of individual activity. Specifically, the top at 12 o'clock is used as the reference point, and the current position of the arrow indicates the amount represented: for example, if 1 minute corresponds to 100 steps, the seconds hand positioned on minute 37 (see FIG. 2) indicates 3700 steps taken. Of course, a different scaling factor can be chosen, for example one sweep of the clock could represent 10,000 steps and the case illustrated in FIG. 2 would therefore indicate 10,000×37/60 which is 6167 steps.

The displayed value may also be a current value as a percentage of a target value to be achieved. For example, if a user has set a goal of 5,000 steps per day, and at the current time the user has only taken 3700, then the seconds hand is positioned on minute 44.

The choice of scale factor may be made locally on the watch or may be made in an application contained in the smart phone 80 connected to the watch.

The position of the seconds hand 3 indicating the amount of individual activity can be made more visible by a highlighted arc 31 representing the progress between zero and the current position of the seconds hand.

Figure 2:
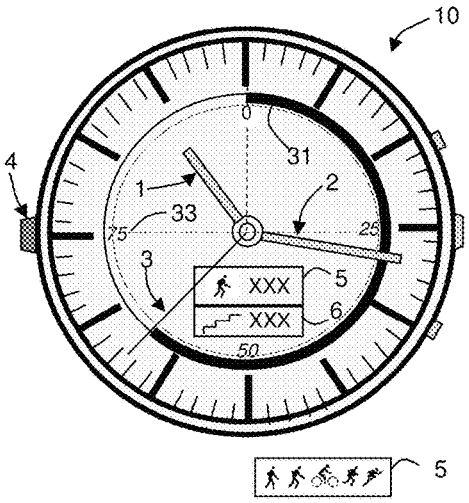
FIG. 2 is another view of the strap watch of FIG. 1 with a gauge-type display using the seconds hand.

A specific gradation may further be provided, for example selective lighting, as shown by reference 33 in FIG. 2.

It should be noted here that the user can easily distinguish the current function of the seconds hand; indeed, when it is indicating the seconds it can be seen to advance in a manner that is well known, whereas if its position remains in place for longer than a second this will indicate that the seconds hand is acting as a gauge displaying some other amount, for example an amount of individual activity.

It is possible to display multiple activity amounts with the seconds hand, sequentially one after the other.

The user can access the display mode for the individual activity amounts in several ways: by using a user button 4,41, by tapping on the face of the watch (the action of tapping on the watch is referred to as "tapping" herein), or by performing a predetermined gesture which generates accelerations that can be measured and recognized as such by the electronic control unit.

Advantageously, it may be arranged so that the seconds display returns after a certain amount of time (predetermined dwell time) during which the user does not execute any actions involving the user buttons, tapping, or said predetermined gestures.

If multiple values are to be displayed, in order to improve the clarity and readability of the information to be displayed it may be arranged so that one of the digital display areas 5,6 is used with appropriate icons to specify the information currently indicated by the seconds hand. Furthermore, the number of steps taken for example can be displayed in the first digital display area 5 and the number of stairs climbed in the second digital display area 6 as shown in FIG. 2, any other display also being possible.

Figure 3:
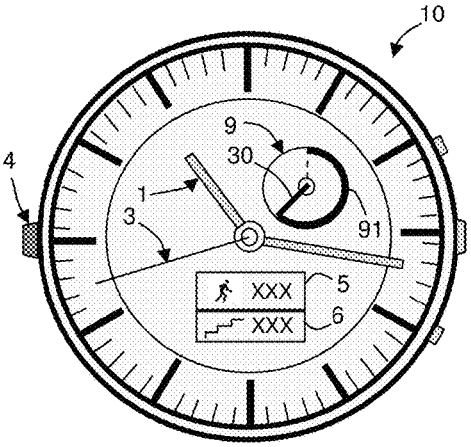
FIG. 3 represents an alternative embodiment of the strap watch of FIG. 1, with a gauge-type display using a specific hand.

In a variant represented in FIG. 3, an amount of individual activity is displayed on a specific analog gauge 9. An additional physical hand 30 is positioned to indicate the current value of the amount to be displayed, relative to the "12 o'clock" reference. This hand 30 is typically a thin rigid stick.

In the same manner as above, it is possible to sequentially display multiple values here, one after the other, either as requested by the user or according to a systematic switching mechanism. This specific display area 9 is always available for displaying one or more activity values.

Figure 7:
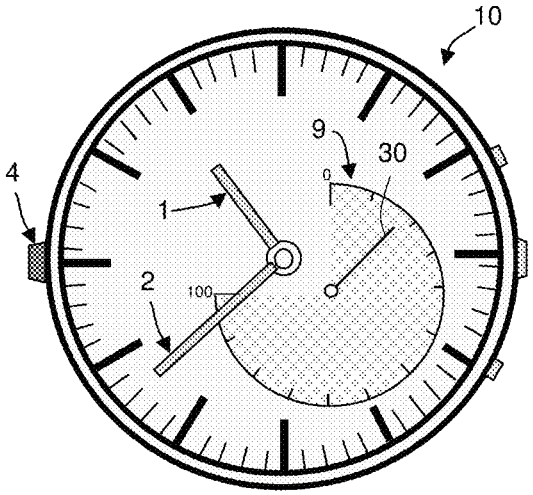
FIG. 7 illustrates a variant of the strap watch of FIG. 1.

In the same manner as above, it is possible to increase readability by displaying an arc 91 between zero and the current position (see FIG. 3). Also, as shown in FIG. 7, the size of the specific analog gauge 9 can be large enough to provide an excellent readability, namely it has a diameter larger than 45% (even 50%) of the outer diameter of the watch.

Also as above, to improve the clarity and readability of the information if multiple values are to be displayed, one or both digital display areas 5,6 may be used.

When the user is performing a physical activity, possibly but not necessarily athletic, he or she can select the type of activity by selecting the mode using, as in the example shown at the bottom of FIG. 2, one of the digital display areas 5,6, where the user can scroll through representative icons by tapping or by actuating one of the user buttons 4,41, and can select the appropriate icon. The electronic control unit 8 uses this mode selection to refine what information is used from the accelerometer(s) and to improve the accuracy of the calculated physical activity amounts.

Figure 6:
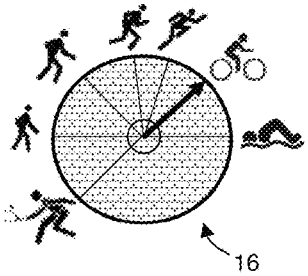
FIG. 6 illustrates an example of a mode selection display.
Figure 4:
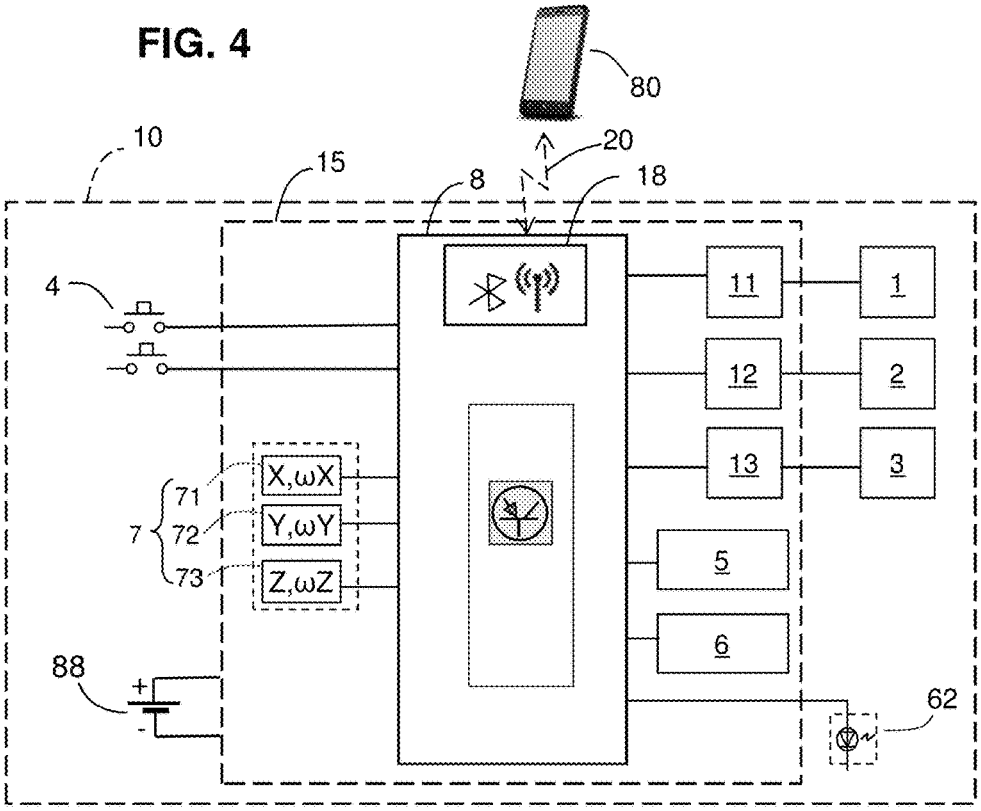
FIG. 4 shows a schematic diagram of the strap watch of FIG. 1, with the addition of a wireless interface.

In a variant of the strap watch represented in FIG. 6, there is a mode selection display area 16 which can be positioned opposite the specific hand display area 9, in another quadrant of the watch. The user can then easily select the type of activity currently being performed, by tapping to scroll through the various options for example.

It may also be arranged so that new icons are added to the mode selection list by an application on the smartphone 80 logically connected to the strap watch. It is then possible to add to the list: slow walking, brisk walking, slow jogging, brisk jogging, running, cycling, tennis, swimming.

The amounts of physical activity are usually calculated as daily totals, by default reset automatically at midnight every day by the electronic control unit. Totals for a period of one week are also possible, however.

In one particular display mode, more than one hand can be used to display one or more physical activity amounts. For example, the hour hand 1 can indicate thousands of units, the minute hand 2 can indicate hundreds of units, and the seconds hand can indicate single units from 0 to 99.

Note that a watch according to the invention has the usual appearance of a conventional analog watch. The size of such a strap watch is completely conventional, and may as small as a conventional women's watch.

According to another aspect of the invention, which is independent of calculating the physical activity amount by means of an accelerometer, the amount indicated on the analog display by the seconds hand 3 or by a specific gauge 30,9 may be received from a remote entity over the wireless connection 20, for example from said smartphone 80 or any other device having wireless communication tools such as a laptop computer, PDA, or touchscreen tablet.

To give a few examples, the amount in question could be a stock price or local weather forecast information, or an indication of the correspondence between a calling party and a list of favorite contacts, or any other information available on the Internet. The display mode and the selection of the amount to be displayed is typically done in the user interface of a smartphone application.

Figure 5:
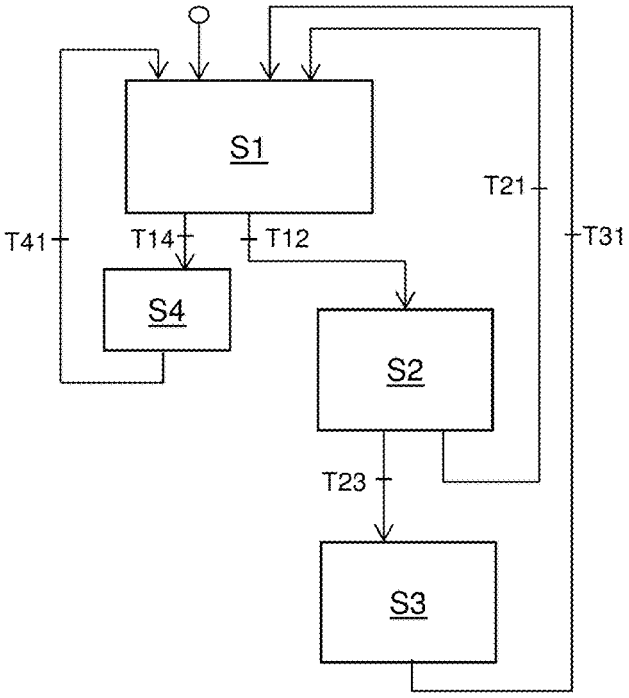
FIG. 5 shows an example flowchart for managing the display modes of the strap watch.

FIG. 5 shows one example among many of a state transition diagram, in which mode S1 represents a conventional time display by the hands, mode S4 is a manual time setting mode, and modes S2 and S3 are particular display modes for the amounts to be displayed, whether determined using the accelerometer or received from a remote entity.

Each of the downward transitions T14, T12, T23 can be triggered by recognition of a type of tapping or predetermined gesture, by means of accelerometer measurements, or by actuation of the user buttons 4,41. The upward transitions T21, T41, T31 can also be triggered by accelerometer detection (tapping or predetermined gesture) or after a predetermined period with nothing detected by the accelerometer.

The invention claimed is:

1. A watch intended to be worn by a user, comprising:

a first hand normally indicating the hours, a second hand normally indicating the minutes, wherein each of first and second hands is a physical piece of material, at least one MEMS accelerometer, an electronic control unit, wherein the electronic control unit is configured so that the electronic control unit normally causes the time to be indicated by the hands, is configured to calculate at least a first individual activity amount representative of a cumulative amount of a corresponding physical activity performed by the user, based on information collected by the at least one accelerometer, and is configured to display said at least first individual activity amount by means of at least one additional hand on a separate analog gauge, over an angular range from 0 to at least 270 degrees, wherein said additional hand is controlled by the electronic control unit, wherein the additional hand is mounted on an axis separate from that of the first and second hands so as to form the separate analog gauge, wherein the at least first individual activity amount displayed is a percentage of a target cumulative amount of the corresponding physical activity to be performed by the user, whereby the user can view one or more amount(s) relating to his or her physical activity on an analog watch interface.

2. The watch according to claim 1 further comprising a tap actuation function.

3. The watch according to claim 1, further comprising at least one pixel-based digital display area, for displaying information related to the physical activity of the user.

4. The watch according to claim 1, further comprising at least one user button, operable by a user in order to select one of an available display modes.

5. The watch according to claim 1, further comprising at least one wireless communication means adapted to allow sending and receiving data to and from a remote entity.

6. The watch according to claim 1, further comprising a mode selection indicator hand to allow the user to see a mode is selected.

7. The strap watch according to claim 1, wherein the MEMS accelerometer is configured to measure accelerations in three orthogonal directions X,Y,Z.

8. The watch according to claim 1, wherein:

the separate gauge is arcuate and has a diameter larger than 45% of the outer diameter of the watch.

9. The watch according to claim 1, wherein each of first and second hands is driven individually by a micro-motor.

10. The watch according to claim 1, wherein the additional hand on the separate gauge has a reference upright position.

11. A method implemented in a strap watch comprising a first hand normally indicating the hours, a second hand normally indicating the minutes, the method comprising the steps of:

a—capturing information, by means of at least a MEMS accelerometer, relating to at least one physical activity of a user, b—calculating at least a first amount of individual activity representative of a cumulative amount of a corresponding physical activity performed by the user, c—displaying, using an analog gauge-based display, said first amount of activity by means of a separate additional hand on a separate analog gauge, over an angular range from 0 to at least 270 degrees, wherein said additional hand is controlled by the electronic control unit, wherein the first activity amount displayed is a percentage of a target cumulative amount of the corresponding physical activity to be performed by the user, wherein the at least first individual activity amount displayed is a percentage of a target cumulative amount of the corresponding physical activity to be performed by the user, and wherein the amount of physical activity is automatically reset every day at night.

12. The method according to claim 11, further comprising the steps of:

causing the first amount of individual activity to be displayed by tapping on the watch or by actuating a user button or by a predetermined gesture.

13. The method according to claim 11, further comprising the step of:

selecting a display mode from among a plurality of available display modes by tapping on the watch or by actuating the user button or by a predetermined gesture.

14. The method according to claim 11, further comprising the step of choosing a scale factor with respect to the target cumulative amount, the choice of the scale factor being performed either locally on the watch or via an application contained in a smartphone.

* * * * *